US006124544A

United States Patent [19]

Alexander et al.

[11] Patent Number: 6,124,544

[45] Date of Patent: Sep. 26, 2000

[54] ELECTRONIC MUSIC SYSTEM FOR DETECTING PITCH

[75] Inventors: John Stern Alexander, Voorhees; Themistoclis George Katsianos, Marlton, both of N.J.

[73] Assignee: Lyrrus Inc., Philadelphia, Pa.

[21] Appl. No.: 09/364,452

[22] Filed: Jul. 30, 1999

[51] Int. Cl.[7] ..... G10H 7/00

[52] U.S. Cl. ..... 84/616; 84/654

[58] Field of Search ..... 84/616, 654, 681

[56] References Cited

U.S. PATENT DOCUMENTS

| | | | |
|---|---|---|---|
| 4,280,387 | 7/1981 | Moog | 84/681 X |
| 4,357,852 | 11/1982 | Suenaga | 84/681 |
| 5,018,428 | 5/1991 | Uchiyama et al. | 84/616 |
| 5,140,886 | 8/1992 | Masaki et al. | 84/616 X |
| 5,210,366 | 5/1993 | Sykes | 84/616 |
| 5,270,475 | 12/1993 | Weiss et al. . | |
| 5,430,241 | 7/1995 | Furuhashi et al. | 84/616 X |
| 5,619,004 | 4/1997 | Dame | 84/654 X |

OTHER PUBLICATIONS

Schepers, H.E., van Beek, J.H.G.M. and Bassingthwaighte, J.B. "Four Methods to Estimate the Fractal Dimension from Self–Affine Signals" IEEE Engineering in Medicine and Biology, vol. 11, pp. 57–64, p. 71, (Jun. 1992).

Thompson, D.J. "Spectrum Estimation and Harmonic Analysis" Proceedings of the IEEE, vol. 70, No. 9, pp. 1055–1091 (Sep. 1982).

Serra, X. "Musical Sound Modeling with Sinusoids Plus Noise" Studies on New Musical Research, Chapter 3, Curtis Roads ed. Swete & Zeitlinger, Lisse (1997).

Bernardi, A., Bugna, G.–P. and De Poli, G. "Musical Signal Analysis with Chaos" Studies on New Musical Research, Chapter 6, Curtis Roads ed., Swets & Zeitlinger, Lisse (1997).

Percival, D.B. and Walden, A.T. "Multitaper Spectral Estimation" Spectral Analysis for Physical Applications, Chapter 7, pp. 331–377, Cambridge University Press (1993).

Percival, D.B. and Walden, A.T. "Calculation of Discrete Prolate Spheroidal Sequences" Spectral Analysis for Physical Applications, Chapter 8, pp. 378–390, Cambridge University Press (1993).

*Primary Examiner*—Stanley J. Witkowski
*Attorney, Agent, or Firm*—Akin, Gump, Strauss, Hauer & Feld, L.L.P.

[57] ABSTRACT

A method for detecting the pitch of a musical signal comprising the steps of receiving the musical signal, identifying an active portion of the musical signal, identifying a periodic portion of the active portion of the musical signal, and determining a fundamental frequency of the periodic portion of the musical signal.

11 Claims, 15 Drawing Sheets

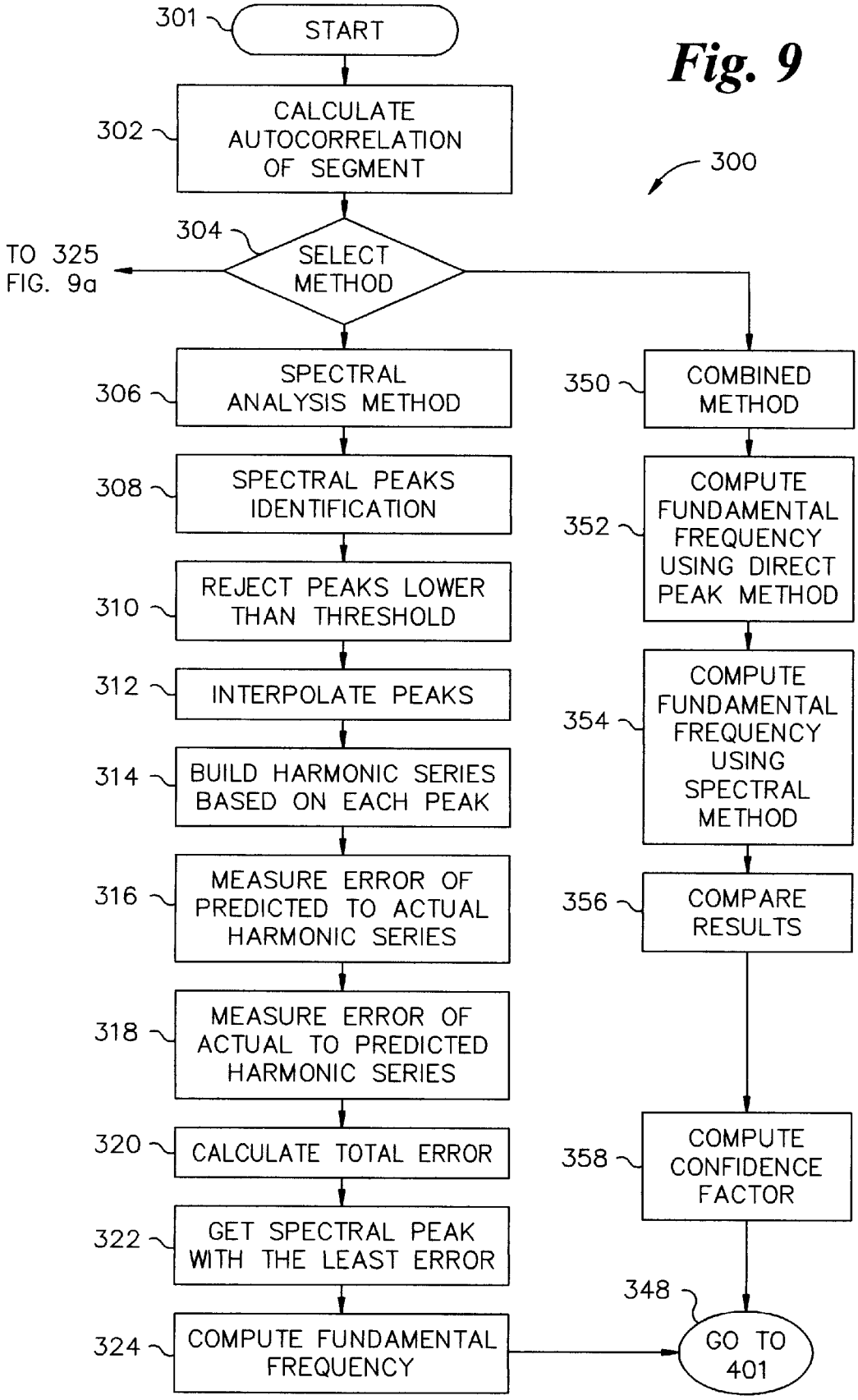
Fig. 9
300
301
START
302
CALCULATE AUTOCORRELATION OF SEGMENT
304
SELECT METHOD
TO 325 FIG. 9a
306
SPECTRAL ANALYSIS METHOD
308
SPECTRAL PEAKS IDENTIFICATION
310
REJECT PEAKS LOWER THAN THRESHOLD
312
INTERPOLATE PEAKS
314
BUILD HARMONIC SERIES BASED ON EACH PEAK
316
MEASURE ERROR OF PREDICTED TO ACTUAL HARMONIC SERIES
318
MEASURE ERROR OF ACTUAL TO PREDICTED HARMONIC SERIES
320
CALCULATE TOTAL ERROR
322
GET SPECTRAL PEAK WITH THE LEAST ERROR
324
COMPUTE FUNDAMENTAL FREQUENCY
350
COMBINED METHOD
352
COMPUTE FUNDAMENTAL FREQUENCY USING DIRECT PEAK METHOD
354
COMPUTE FUNDAMENTAL FREQUENCY USING SPECTRAL METHOD
356
COMPARE RESULTS
358
COMPUTE CONFIDENCE FACTOR
348
GO TO 401

FROM 304

325
DIRECT PEAK METHOD
326
GET 5 HIGHEST MAGNITUDES
328
GET PEAKS > MAGNITUDE THRESHOLD
330
CALCULATE DISTANCES
332
CALCULATE MEAN & VARIANCE
334
PEAKS EVENLY SPACED?
NO
YES
336
COMPUTE FUNDAMENTAL FREQUENCY
348
GO TO 401
340
GET NEXT HIGHER MAGNITUDE
338
MAGNITUDES REMAINING?
YES
NO
341
DETECTION FLAG = 1?
NO
YES
342
DECLARE NOTE OFF
344
SET DETECTION FLAG = 0
346
GO TO 103

ELECTRONIC MUSIC SYSTEM FOR DETECTING PITCH

BACKGROUND OF THE INVENTION

The present invention relates generally to electronic music systems and more particularly to an electronic music system which generates an output signal representative of the pitch of a musical signal.

Musical signals are vocal, instrumental or mechanical sounds having rhythm, melody or harmony. Electronic music systems employing a computer which receives and processes musical sounds are known. Such electronic music systems produce outputs for assisting a musician in learning to play and/or practicing a musical instrument. Typically, the computer may generate audio and/or video outputs for such learning or practicing representing a note, scale, chord or composition to be played by the user and also, audio/video outputs representing what was actually played by the user. The output of the electronic music system which is typically desired is the perceived audio frequency or "pitch" of each note played, provided to the user in real time, or in non-real time when the musical signal has been previously recorded in a soundfile.

Certain electronic music systems rely on keyboards which actuate switch closures to generate signals representing the pitch information. In such systems, the input device is not in fact a traditional musical instrument. Desirably, an electronic music system operates with traditional music instruments by employing an acoustic to electrical transducer such as a magnetic pickup similar to that disclosed in U.S. Pat. No. 5,270,475 or a conventional microphone, for providing musical information to the electronic music system. Such transducers provide an audio signal from which pitch information can be detected. However, due to the complexity of an audio signal waveform having musical properties, time domain processing, which relies principally on zero crossing and/or peak picking techniques, has been largely unsuccessful in providing faithful pitch information. Sophisticated frequency domain signal processing techniques such as the fast Fourier transform employing digital signal processing have been found necessary to provide the pitch information with the required accuracy. Such frequency domain signal processing techniques have required special purpose computers to perform pitch detection calculations in real time.

One problem faced in detecting pitch from a musical signal is that caused by noise within the signal, i.e. that part of the audio signal that can not be characterized as either periodic or as the sum of periodic signals. Noise can be introduced into the musical signal by pickup from environmental sources such as background noise, vibration etc. In addition, noisy passages can occur as an inherent part of the musical signal, especially in certain vocal consonant sounds or in instrumental attack transients. Such noise adds to the computational burden of the pitch detection process and if not distinguished from the periodic portion of the signal, can bias the pitch measurement result. Traditional methods for removing noise using frequency domain filtering the signal are only partially successful because the noise and the periodic portion of the signal often share the same frequency spectrum. Alternatively, the noise passages may be excised. Conventionally, the noisy passages to be excised are identified by autocorrelating the musical signal. However, the autocorrelation technique has proven unreliable in distinguishing noise from the complex periodic waveforms characteristic of music.

A problem one faces when using frequency domain signal processing techniques is the introduction of artifacts into the output of the analysis. Such artifacts are introduced when the frequencies present in the musical signal to be processed are not harmonically related to the digital signal processing sampling rate of the musical signal. The Fourier transform of such sampled signals indicates energy at frequencies other than the true harmonics of the fundamental frequency, leading to inaccurate determination of the pitch frequency.

The present invention provides an improved method for detecting the pitch of instrumental, vocal and other musical signals, such method reducing the computational burden of pitch detection sufficiently to allow real time pitch detection to be implemented on a standard personal computer having a standard sound input card, without the need for additional hardware components. The present invention overcomes the problems introduced by noise by providing a computationally efficient noise detection method. The noise detection method, based on computing the local fractal dimension of the musical input signal, provides a reliable indication of noise for removing noisy time segments of the signal from the processing stream prior to measuring the pitch. The present invention further provides an improved spectral analysis method, based on multitaper spectral analysis, which reduces the magnitude of artifacts in the spectral analysis output, thus improving the accuracy of the pitch measurement. By the simple addition of driver software to a standard personal computer and connection of an audio transducer or a microphone into the sound card input port, a user is able to observe an accurate, real time rendition of an acoustic, wind or percussion instrument, the human voice or other musical signals and to transmit the information representing the rendition over a computer interface to other musicians, educators and artists.

BRIEF SUMMARY OF THE INVENTION

Briefly stated, the present invention comprises a computerized method for detecting the pitch of a musical signal comprising the steps of receiving an electrical signal representative of the musical signal, identifying an active portion of the musical signal, identifying a periodic portion of the active portion of the musical signal, determining a fundamental frequency of the periodic portion of the musical signal and generating a pitch signal based on the fundamental frequency.

The present invention further comprises a programmed computer for determining the pitch of a musical signal. The computer comprises: an input device for receiving an electrical representation of a musical signal; a storage device having a portion for storing computer executable program code; a processor for executing the computer program stored in the storage device wherein the processor is operative with the computer program code to: receive the electrical representation of the musical signal; identify an active portion of the musical signal; identify a periodic portion of the musical signal; and determine a fundamental frequency of the periodic portion of the musical signal; and, an output device for outputting pitch signal based on the fundamental frequency.

The present invention also comprises a computer readable medium having a computer executable program code stored thereon for determining the pitch of a musical signal. The program comprises: code for receiving an electrical representation of a musical signal; code for identifying an active portion of the musical signal; code for identifying a periodic portion of the musical signal; code for determining a fundamental frequency of the periodic portion of the musical signal and code for generating a pitch signal based on the fundamental frequency.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
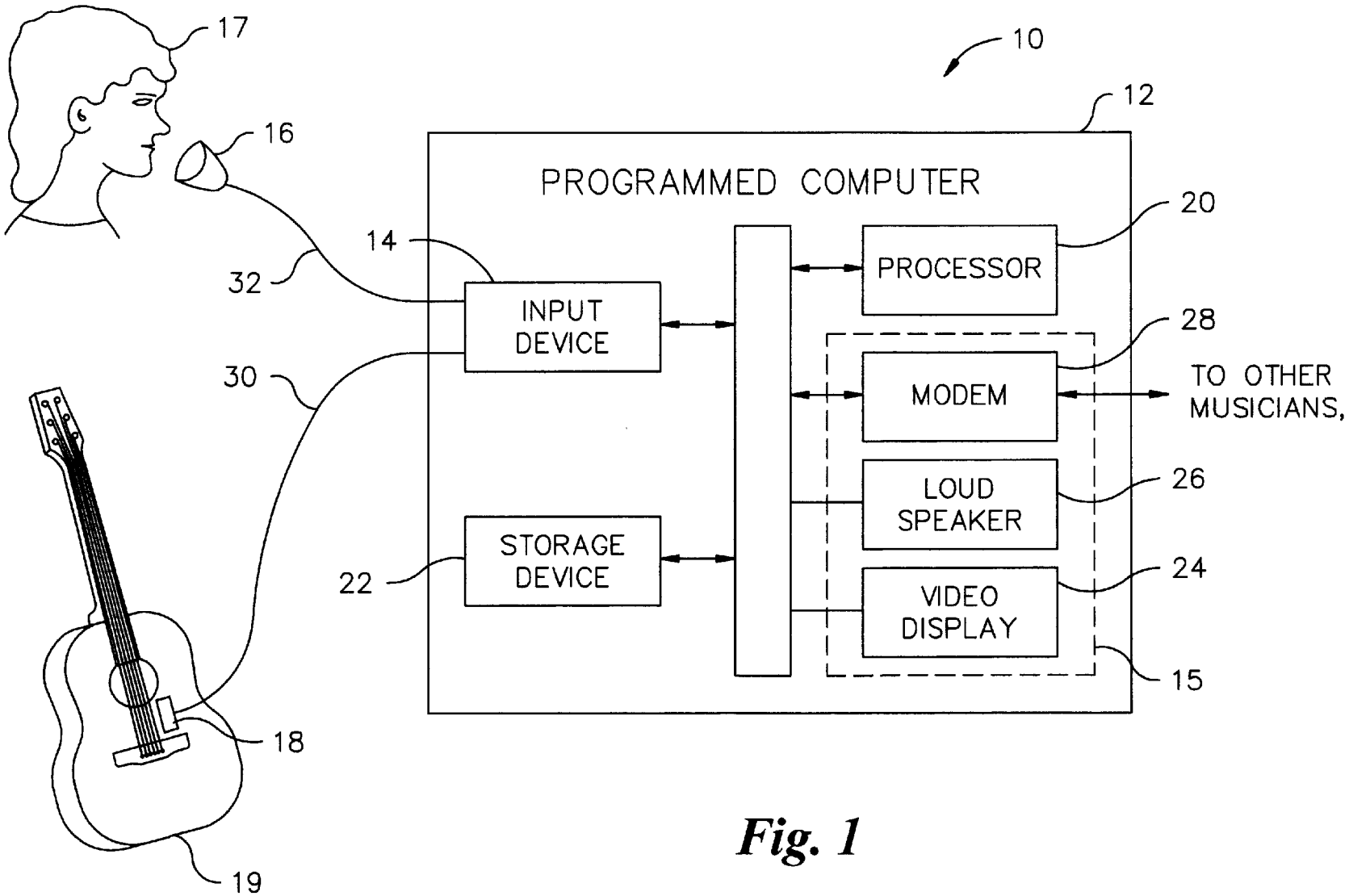
FIG. 1 is a functional block diagram of an electronic music system according to a preferred embodiment of the present invention.

In the drawings, wherein like numerals are used to indicate like elements throughout, there is shown in FIG. 1 a presently preferred embodiment of an electronic music system 10 for detecting the pitch of a musical signal. The preferred embodiment comprises a programmed computer 12 comprising an input device 14 for receiving an electrical representation of a musical signal, a storage device 22 having a portion for storing computer executable program code (computer program), a processor 20 for executing the computer program stored in the storage device 22 and an output device 15 for outputting the pitch information to the user.

The processor 20 is operative with the computer program code to receive the electrical representation of the musical signal, identify an active portion of the musical signal, identify a periodic portion of the musical signal and determine a fundamental frequency of the periodic portion of the musical signal The electronic music system 10 operates with a transducer 18, shown attached to a guitar 19 and providing an electrical signal representative of the vibrations of the strings of the guitar 19 to the programmed computer 12 over a transducer input line 30. Although a guitar 19 is shown, it will be understood that the present invention may be used with other string or non-string instruments. The preferred embodiment of the present invention also operates with a microphone 16 for receiving sound waves from a musical instrument such as a recorder or a trumpet (not shown), or from the voice tract of a human 17, for providing electrical signals representative of the sound waves to the programmed computer 12 over a microphone input line 32.

Desirably, the programmed computer 12 is a type of open architecture computer called a personal computer (PC). In the preferred embodiment, the programmed computer 12 operates under the Windows™ operating system manufactured by Microsoft Corporation and employs a Pentium III™ microprocessor chip manufactured by Intel Corporation as the processor 20. However, as will be appreciated by those skilled in the art, other operating systems and microprocessor chips may be used. Further, it is not necessary to use a PC architecture. Other types of computers, such as the Apple Macintosh computer manufactured by Apple Inc. may be used within the spirit and scope of the invention.

In the preferred embodiment, the input device 14 for receiving the microphone 16 and transducer 18 electrical input signals is commonly referred to as a sound card, available from numerous vendors. Typically, the sound card provides an audio amplifier, bandpass filter and an analog-to-digital converter, each of a kind well known to those skilled in the art, for converting the analog electrical signal from the microphone 16 and the analog electrical signal from the transducer 18 into a digital signal compatible with the components of the programmed computer 12.

The programmed computer 12 also includes a storage device 22. Desirably, the storage device 22 includes a random access memory (RAM), a read only memory (ROM), and a hard disk memory connected within the programmed computer 12 in an architecture well known to those skilled in the art. The storage device 22 also includes a floppy disk drive and/or a CD-ROM drive for entering computer programs and other information into the programmed computer 12. The output device 15 includes a modem 28 for connecting the programmed computer 12 to other computers used by other musicians, instructors etc. The connection of the modem 28 to other musicians may be via a point-to-point telephone line, a local area network, the Internet etc. The output device 15 also includes a video display 24 where for instance, the notes played on a musical instrument or sung are displayed on a musical staff, and one or more speakers 26 so that the musician and others can listen to the notes played.

In the preferred embodiment the executable program code for determining the pitch of a musical signal is stored in the ROM. However, as will be appreciated by those skilled in the art the program code could be stored on any computer readable medium such as the hard disk, a floppy disk or a CD-ROM and still be within the spirit and scope of the invention. Further, the computer program may be implemented as a driver that is accessed by the operating system and application software, as part of an application, as part of a browser plug-in or as part of the operating system.

Figure 2B:
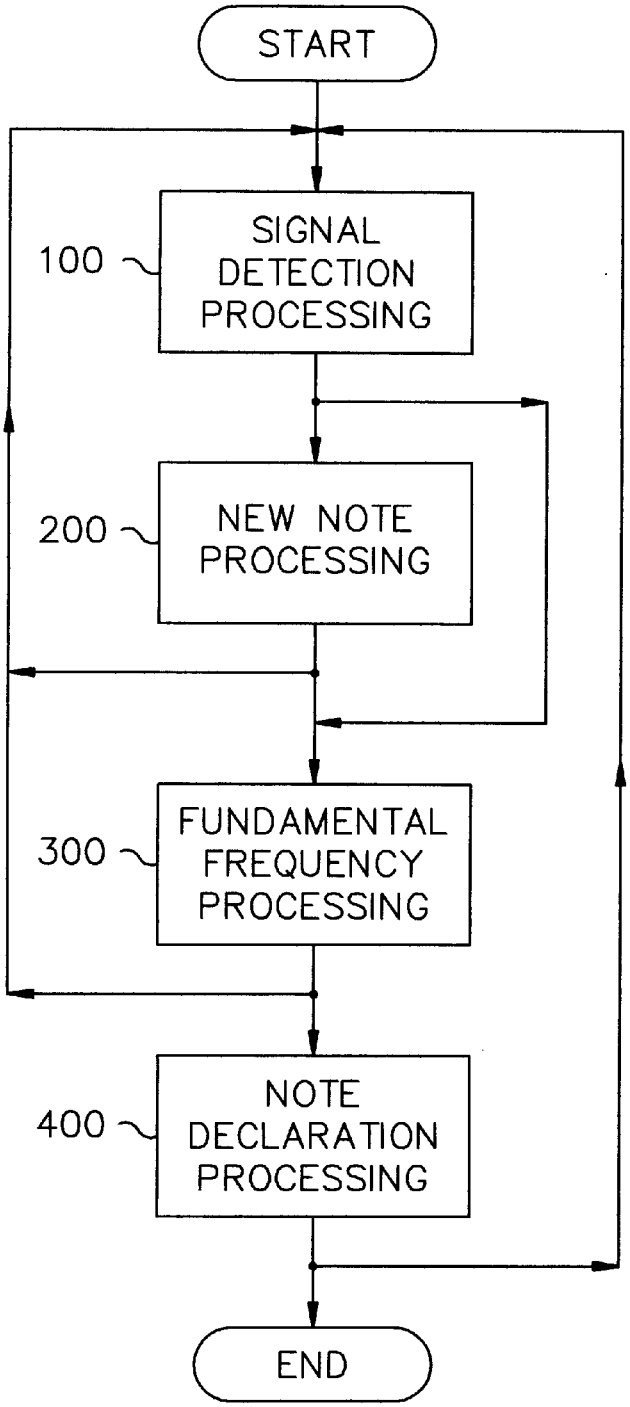
FIGS. 2*a* and 2*b* are flow diagrams of a pitch detection method according to the preferred embodiment.
Figure 2A:
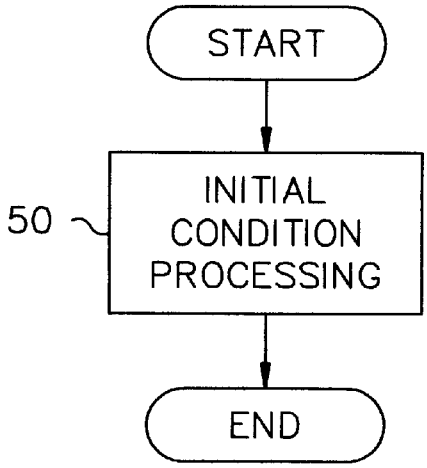

Referring now to FIGS. 2*a* and 2*b* there is shown a method for detecting the pitch of a musical signal received by the computer 12 comprising the steps of initial condition processing (step 50) comprising initializing the computer program to initial conditions; signal detection processing (step 100) comprising receiving and identifying as active, a portion of the musical input signal by detecting if the portion of the input signal meets a predetermined amplitude criteria; new note processing (step 200) comprising processing the active portion of the input signal to determine if the active portion is a noise-like signal; fundamental frequency processing (step 300) comprising identifying as periodic the portions of the active signal that are not noise-like and for which a fundamental frequency is determined; and note declaration processing (step 400) comprising accumulating the results of processing a sequence of the active portions of the input signal to declare the formation of notes and to output information to the user describing the pitch of successive notes characteristic of the musical input signal received by the electronic music system 10.

In the preferred embodiment, the computer program is initialized to initial conditions (step 50) according to the preferences of the user, the type of musical signal and the type of computer. Flags corresponding to a signal detection (detection flag) and a new note (new note flag) are initialized. Also, counters for counting noise and note sequences, as described below, are initialized. A fractal dimension flag (FD flag), which determines whether noise processing in step 200 will be invoked, is set by the user, generally according to whether the input signal has noise-like characteristics or not. Also, a PMTM flag, which determines the method to be used for pitch determination is user set, generally corresponding to the processing power of the processor 20. The user may also adjust the levels of various input signal detection thresholds according to the type of musical instrument and transducer 18.

Figure 3A:
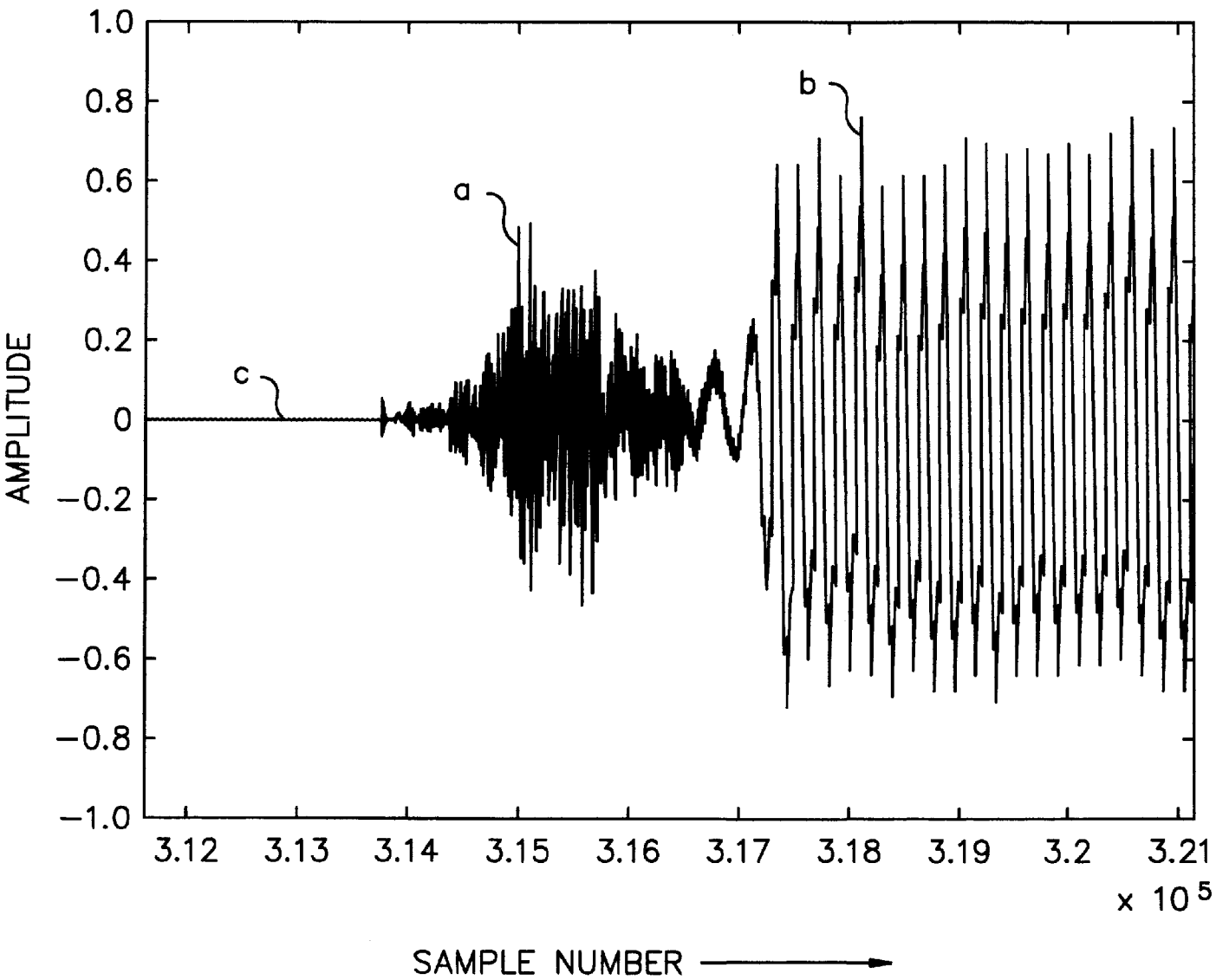
FIGS. 3*a* and 3*b* are illustrations of typical sung notes.
Figure 3B:
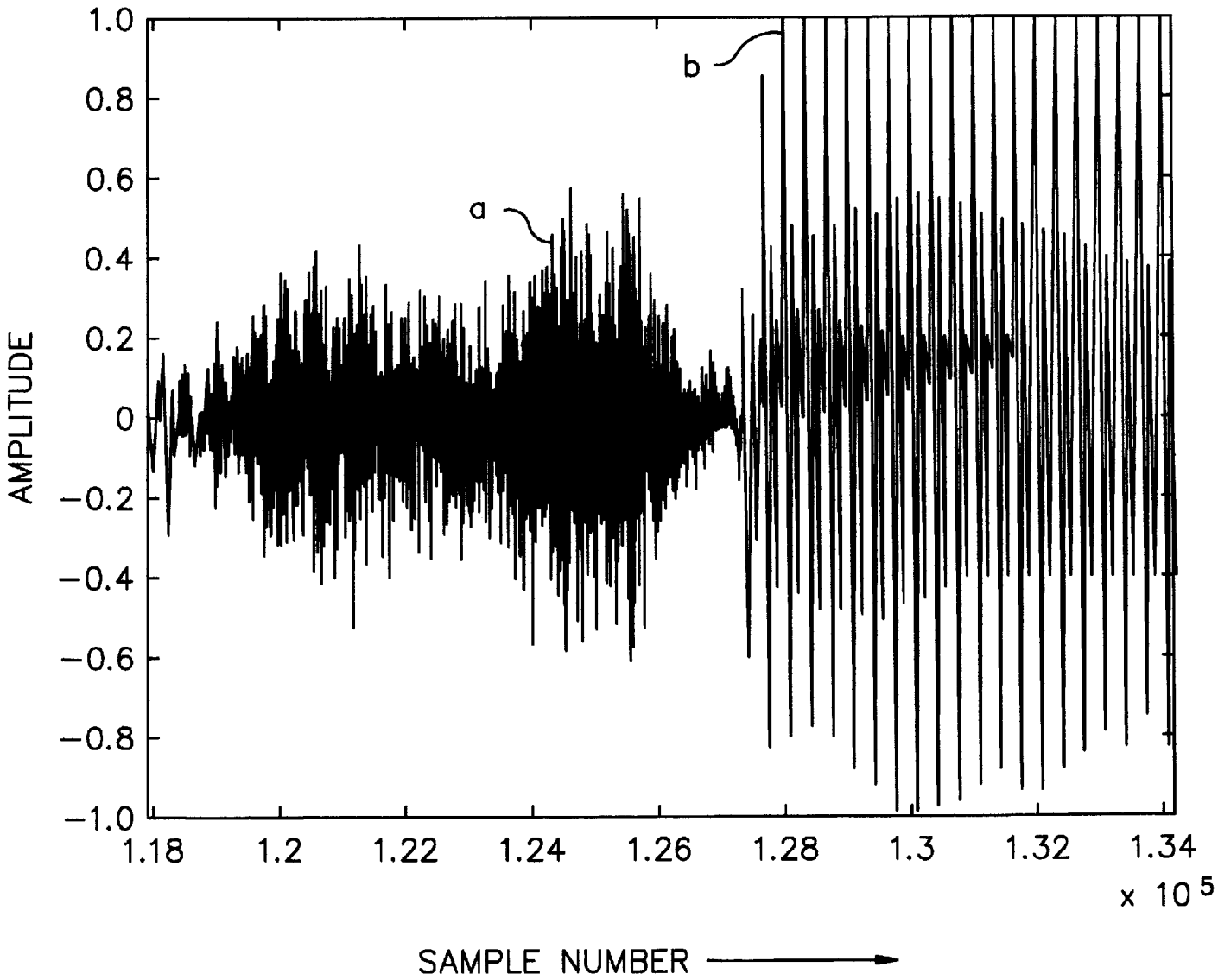

As shown in FIGS. 3*a* and 3*b* the time domain waveform of a typical musical signal is characterized by portions or periods of noise-like signals (a), periodic signals (b) and silence (c). The pitch of the signal is the fundamental frequency of the periodic portion of the signal. In order to minimize the amount of computer processing associated with determining the fundamental frequency of the input signal, it is desirable to be able to eliminate the signal portions from processing in which the input signal is either noise-like or silent. A musical signal may also transition from one note into the following note without a substantial period of silence or noise (not shown in FIGS. 3*a* and 3*b*). The transition may be accompanied by an amplitude change or a frequency change of the input signal. It is also desirable to be able to identify the transition points in the input signal.

Figure 4:
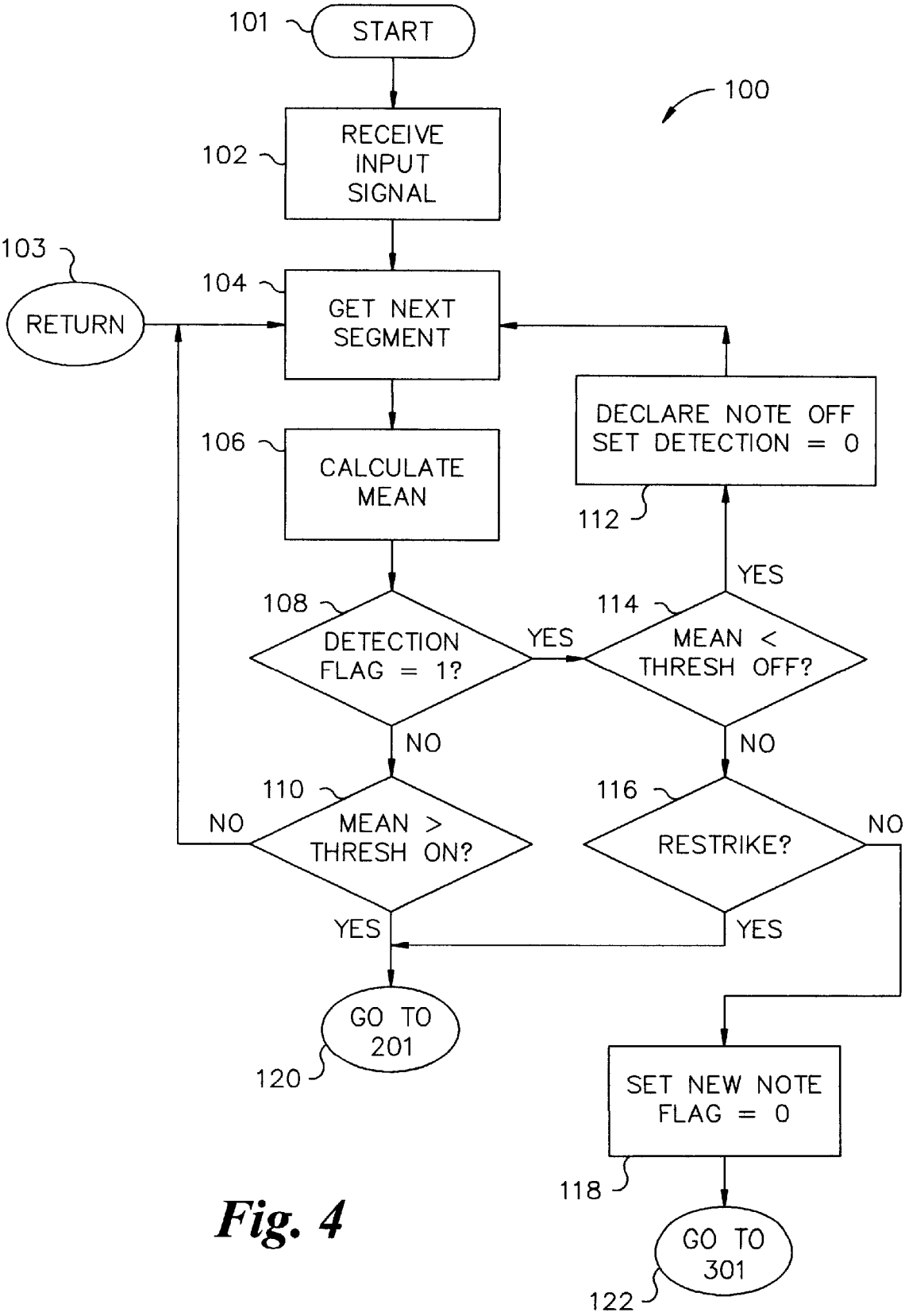
FIG. 4 is a flow diagram of the steps for detecting a segment of a musical signal based on the mean amplitude of the segment.

FIG. 4 is a flow diagram of a preferred embodiment of signal detection processing (step 100) illustrating the steps comprising testing the input signal mean value against at least one predetermined detection threshold value to determine whether a portion of the input signal meets predetermined amplitude threshold criteria. In the preferred embodiment, the step of detecting the musical signal includes receiving and pre-processing by the input device 14, the electrical input signal generated by the transducer 18 or the microphone 16 (step 102). The input device 14 amplifies and filters the input signal to enhance signal-to-noise ratio of the input signal. When the input signal received over transducer line 30 is from a guitar 19, the filter bandwidth is adjusted to extend from about 82 Hz. to about 1300 Hz. When the signal input received from the microphone 16 over the microphone input line 32 is from the vocal tract of a female human 17, the filter bandwidth is adjusted to extend from about 220 to about 587 Hz. Other bandwidths are established accordingly. After amplification, the input signal is sampled at a rate of about 44,000 samples per second and each sample is converted to a 16 bit digital representation by the analog-to-digital converter of the input device 14. The digitized input signal samples are subsequently blocked into segments, each segment comprising 660 samples and representing about 14 msec. of the input signal. As one skilled in the art will appreciate, the filter bandwidth, sampling rate, segment size and digitization precision may be varied depending upon the characteristics of the input signal and the particular components selected for the programmed computer 12. In step 104, a segment of the input signal comprising about 14 msec. of input signal samples is transferred from the input device 14 to the processor 20. At step 106, the mean of the amplitude of the absolute values of the segment signal samples is determined. At step 108, the detection flag is tested to determine if the detection loop is active from a previous detection. If at step 108, the detection flag value is zero, the segment mean value is compared with a predetermined signal-on threshold, $T_{on}$, at step 110. If at step 110 the segment mean value exceeds the $T_{on}$ threshold, the segment samples are passed to new note processing at step 120. Alternatively, if the segment mean value is less than the $T_{on}$ threshold, the computer program returns to step 104 and retrieves the next segment of data.

If the detection flag value is found equal to one at step 108, a note is currently being processed. Consequently, the mean value of the segment is tested against the threshold, $T_{off}$, at step 114. If the mean value of the current segment has dropped below the threshold $T_{off}$, the detection flag is reset to zero, the note is declared off and the next input signal segment is retrieved. If the segment mean value is equal to or greater than the threshold, $T_{off}$, the segment is tested to determine if there has been a restrike by comparing the current segment mean value against the previous segment mean value at step 116. If the ratio of the current mean value to the preceding mean value exceeds a predetermined value, $T_r$, it indicates that a new note transition has occurred without an intervening silent period and processing is passed at step 120 to new note processing (step 200). Alternatively, if the ratio of the current mean value to the previous mean value is below the threshold, $T_r$, continuation of the same note is indicated, the new note flag is set to zero at step 118, and processing is passed at step 122 to fundamental frequency processing (step 300).

Figure 5:
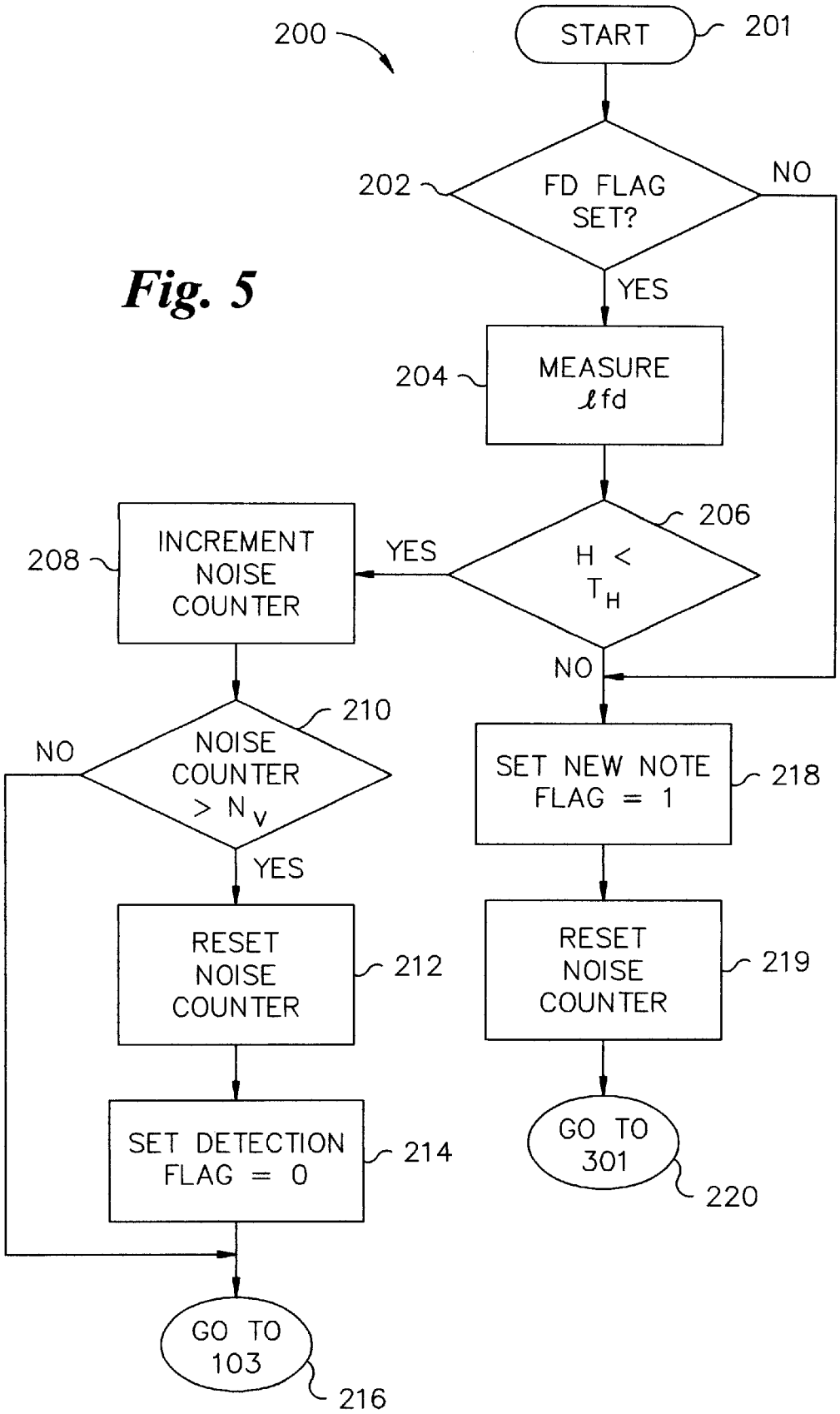
FIG. 5 is a flow diagram of the steps for determining if the segment represents the beginning of a new note.

FIG. 5 is a flow diagram of a preferred embodiment of new note processing (step 200) for determining if an active input signal segment is noise-like. For some kinds of musical signals, such as those provided by a recorder, there is only a small likelihood that the input signal has noise-like portions. For other types of instruments known to have non-noisy acoustic characteristics, the FD flag may be initially set by the user to equal the value one in order to bypass the step of determining if the segment is noise-like. Accordingly, at step 202, the FD flag is tested and if the FD flag value is equal to one, the new note flag is set equal to one at step 218 and the pitch detection computer program continues with the fundamental frequency determination process (step 300). However, as shown in FIGS. 3*a* and 3*b* which illustrate the onsets of the sung words "gee" and "see" respectively, many musical signals have both noise-like and periodic portions. Only the periodic portion of the input signal is useful for detecting pitch. Accordingly, if the FD flag has not been set equal to one, the next step in detecting pitch after testing the FD flag value is determining if the current segment of the input signal is noise-like.

The new note process employs a calculation of the local fractal dimension (lfd) to determine whether each segment is periodic or noise-like. The fractal measurement of each segment determines the amount of self similarity in the segment, which in the case of musical signals is the amount of periodicity. Desirably, the method for determining the lfd is based on the method of relative dispersion (see for background, Schepers, H. E., J. H. G. M. van Beek, and J. B. Bassingthwaighte, *Comparison of Four Methods to Estimate the Fractal Dimension From Self Affine Signals,* IEEE Eng. Med. Biol., 11:57–64, 71, 1992.)

Figure 6:
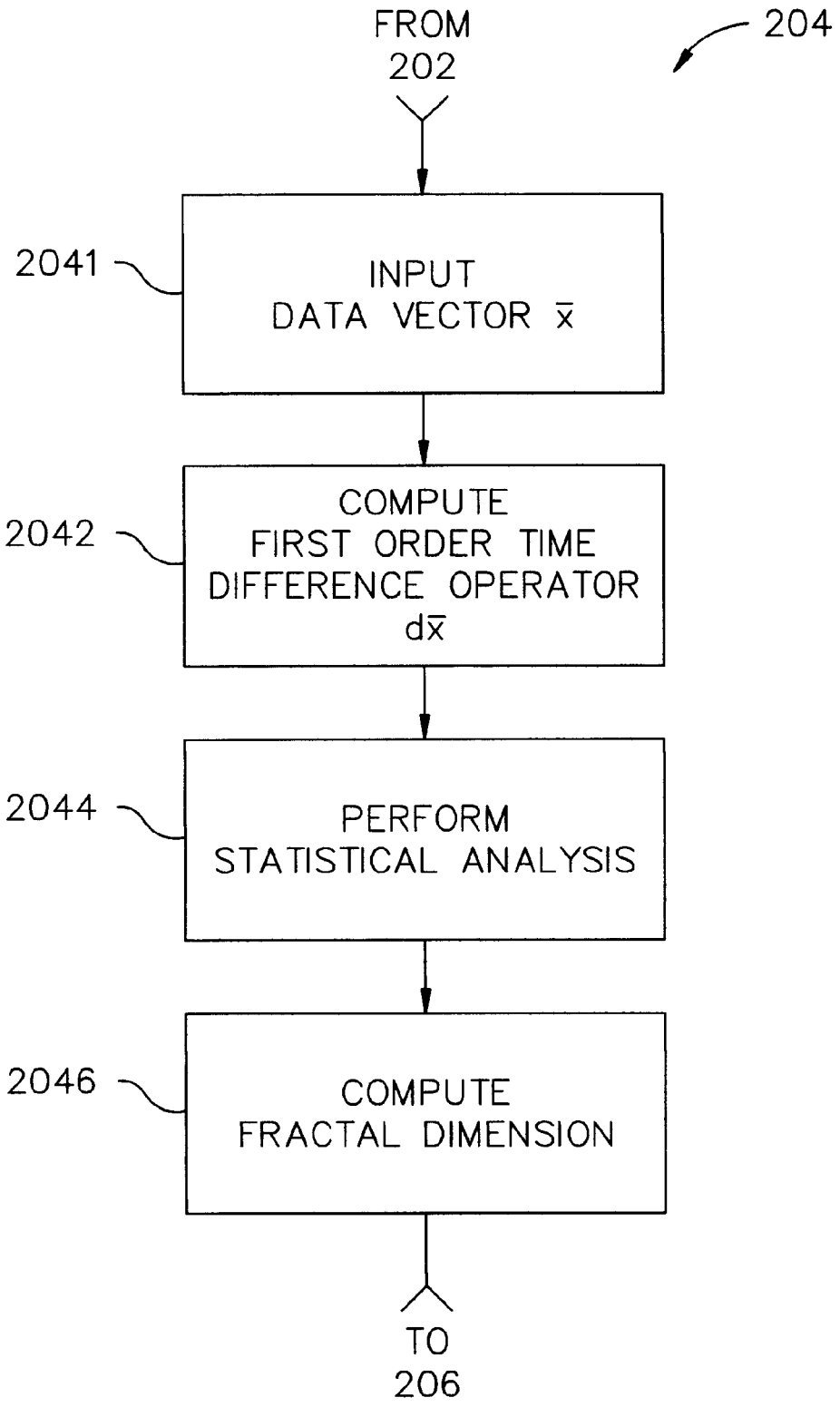
FIG. 6 is a flow diagram of the process for determining the local fractal dimension of the segment.

As shown in FIG. 6, the lfd of a segment determined according to the method of relative dispersion consists of the steps 2041–2046. At step 2041 an N×1 vector $\bar{x}$ is formed from the N segment samples. At step 2042 a new N−1×1 vector $d\bar{x}$, the first order difference of the vector $\bar{x}$, is formed according to equation (1).

$$d\bar{X}=\bar{X}(n+1)-\bar{X}(n), n=1 \ldots N-1 \tag{1}$$

At step 2044, a factor rs is computed according to equation (2)

$$rs = \frac{\max(\bar{X} - \text{mean}(d\bar{X})) - \min(\bar{X} - \text{mean}(d\bar{X}))}{std(d\bar{X})} \tag{2}$$

where:

max ($\bar{x}$—mean($d\bar{x}$)) is the maximum value of the vector formed from the difference of the vector $\bar{x}$ minus the arithmetic average of the difference vector $d\bar{x}$;

min ($\bar{x}$—mean($d\bar{x}$)) is the minimum value of the vector formed from the difference of the vector $\bar{x}$ minus the arithmetic average of the difference vector $d\bar{x}$; and std($d\bar{x}$) is the standard deviation of the difference vector $d\bar{x}$ At step 2046, the lfd is computed according to equation (3).

$$lfd = 1 - \frac{\log(rs)}{\log(N)} \tag{3}$$

The lfd and a parameter H (the Hurst coefficient) are related by equation (4).

$$lfd=2-H \tag{4}$$

Figure 7A:
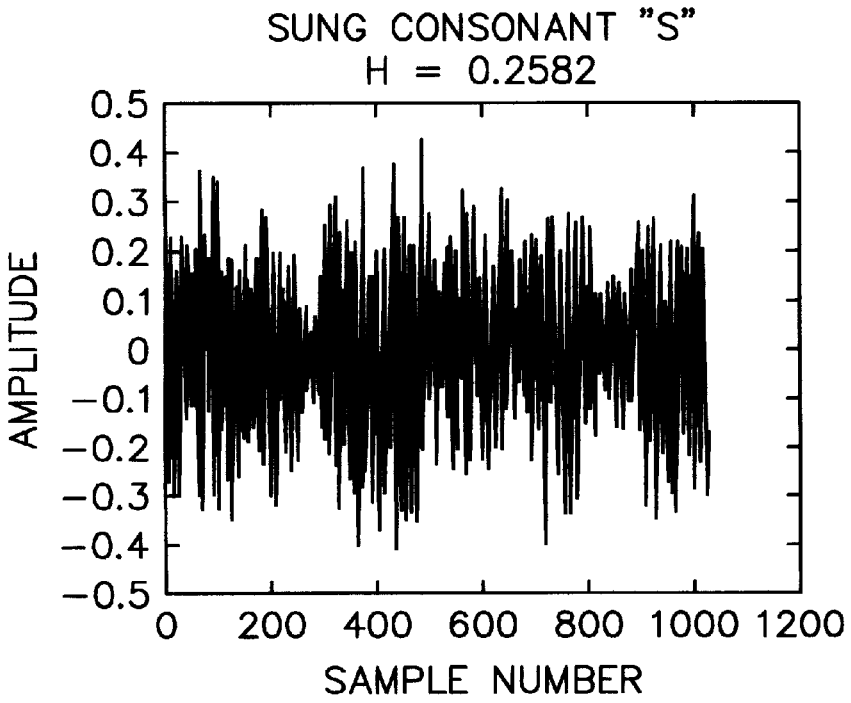
FIG. 7*a* is a an illustration of a noise-like portion of the sung word "sea"
Figure 7B:
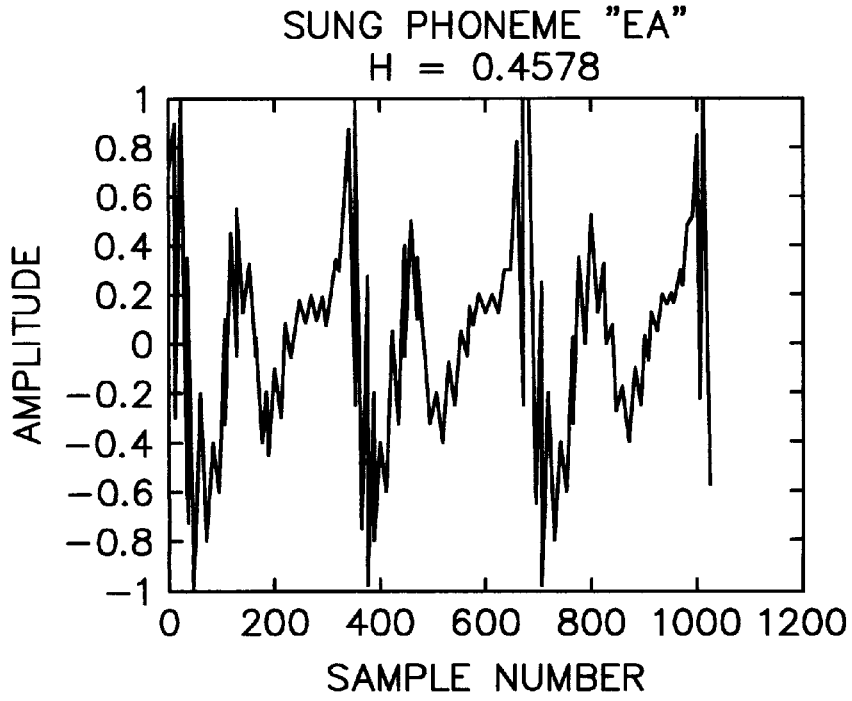
FIG. 7*b* is an illustration of a periodic portion of the sung word "sea"

FIGS. 7*a* and 7*b* are illustrations of the time domain representation of two signal segments taken from the sung word "sea". The onset of the word "sea" (FIG. 7*a*) consists of the consonant "s" which is mainly noise-like. The measurement of the lfd of the onset portion of the signal produces H=0.2582, indicative of a noise-like signal. When the lfd is measured in the periodic portion, "ea", of the signal (FIG. 7*b*) a value of H=0.4578 is obtained, indicative of periodicity. As will be appreciated by those skilled in the art, it is not necessary to calculate the lfd using the method of relative dispersion. Other methods of calculating the local fractal dimension may be used, within the spirit and scope of the invention.

Referring now to FIG. 5, if the segment has been determined have a value of H greater than or equal to a local fractal dimension threshold value $T_H$ (steps 204–206), the segment is determined to be not noise-like, the new note flag is set to a value equal to one (step 218), the noise counter is reset (step 219), and processing of the segment is passed at step 220 to the fundamental frequency processing (step 300). If the segment has been determined to have a value of H less than $T_H$ (steps 204–206), the segment is determined to be noise-like and the noise counter is incremented (step 208). If the value of the noise counter is found to be less than a predetermined value, $N_v$, (step 210) the segment is discarded and the processing returns at step 216 to step 103 to retrieve the next segment. If, at step 210, the noise counter value is equal to or greater than the predetermined value, $N_v$, a long sequence of noise-like segments has occurred, the noise counter is reset at step 212, the detection flag is reset to zero at step 214 and the processing returns at step 216 to step 103.

Figure 8:
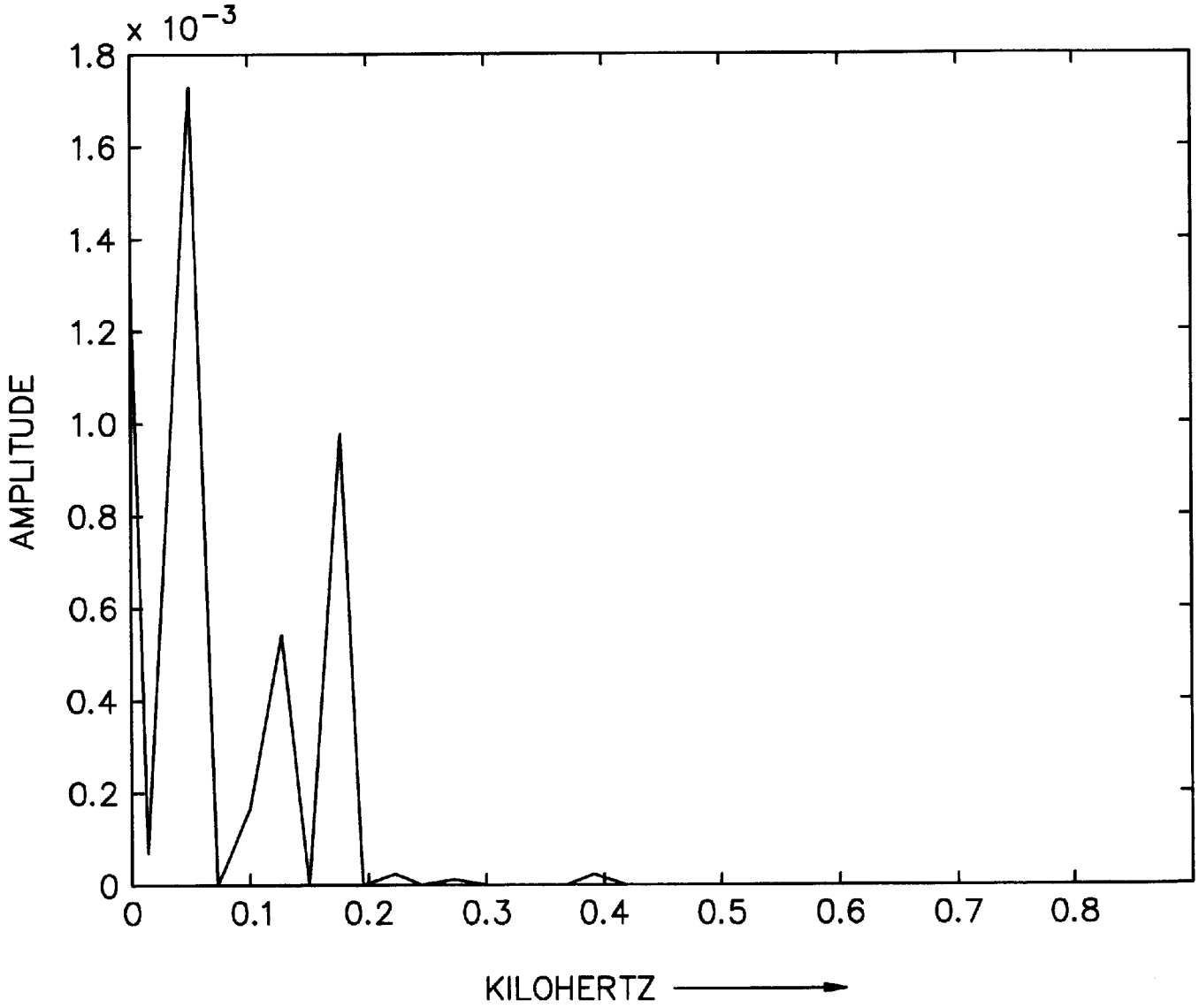
FIG. 8 is an illustration of the power spectrum resulting from striking the "g" string of a guitar.

Providing the user with a determination of the pitch of the musical input signal, as shown in step 400 (FIG. 2), requires determination of the fundamental frequency (or fundamental period of the time domain waveform) of the periodic portions of the input signal. As can be seen in FIGS. 3*a* and 3*b*, which are illustrations of the input signal viewed in the time domain, the periodic portions of the input signal are complex waveforms for which the fundamental period of the waveform is not readily apparent. When the input signal is viewed in the frequency domain, the input signal appears as a harmonic series. The pitch is the lowest frequency for which the line spectrum components are harmonics. As shown in FIG. 8, which illustrates the power spectrum resulting from striking the "g" string of a guitar, the fundamental frequency may not be readily apparent in the power spectrum.

Figures 9, 9A:
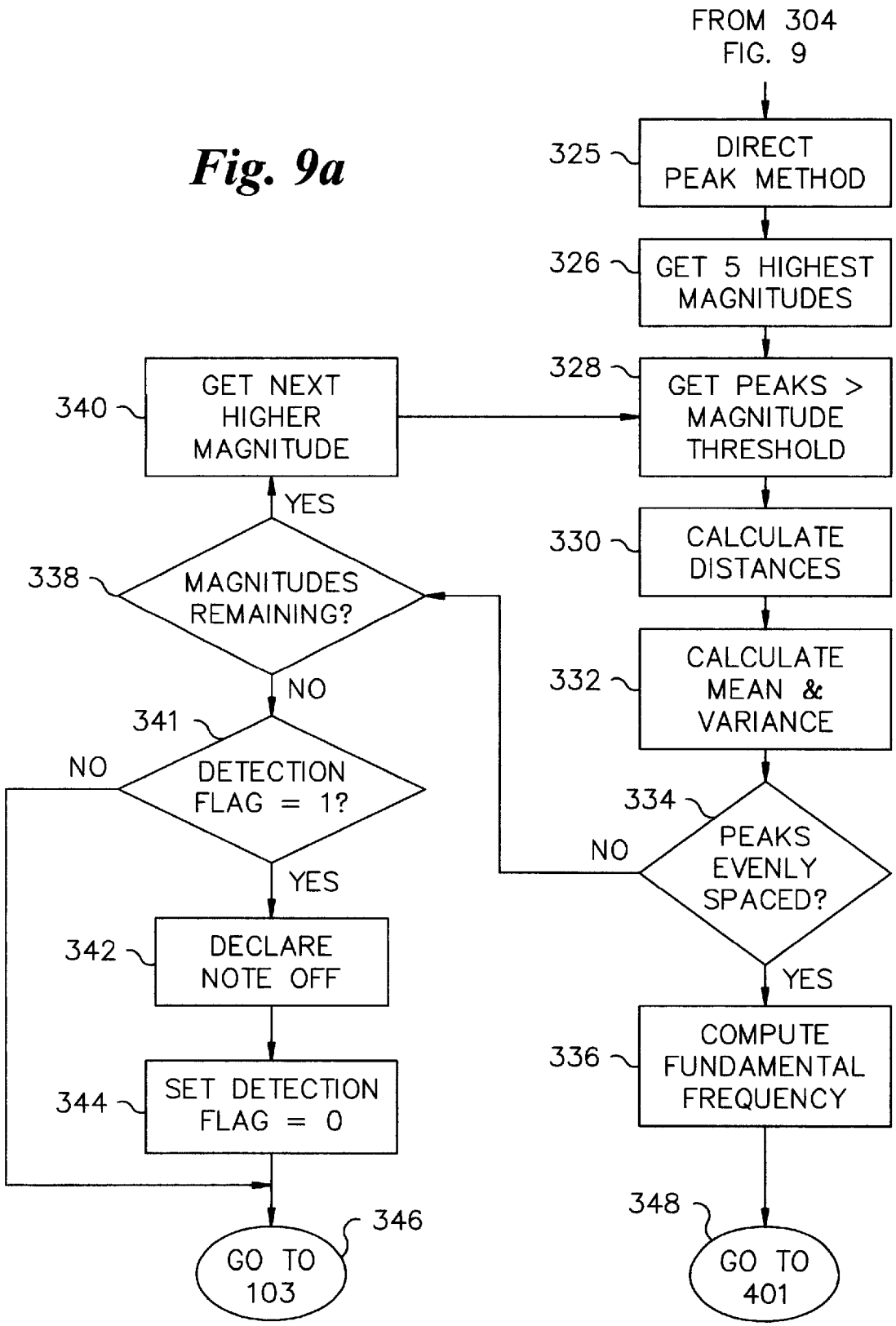
FIGS. 9–9*a* is a flow diagram of the steps for determining the fundamental frequency of the segment.

Shown on FIGS. 9–9*a* is a flow diagram of a preferred embodiment of fundamental frequency processing (step 300). The initial step in determining the fundamental frequency of a each segment of a musical input signal is that of computing the autocorrelation, $\phi_{xx}(n)$, of each segment (step 302). In the preferred embodiment the autocorrelation of each input signal segment is computed by summing the lagged products of the segment signal samples in a conventional manner according to equation (5).

$$\phi_{xx}(n) = \sum_{k=0}^{M-1} x_k x_{k+n} \quad n = 0, 1, \ldots, M-1 \tag{5}$$

where $x_k$ is the kth sample of an input signal segment.

Figure 10A:
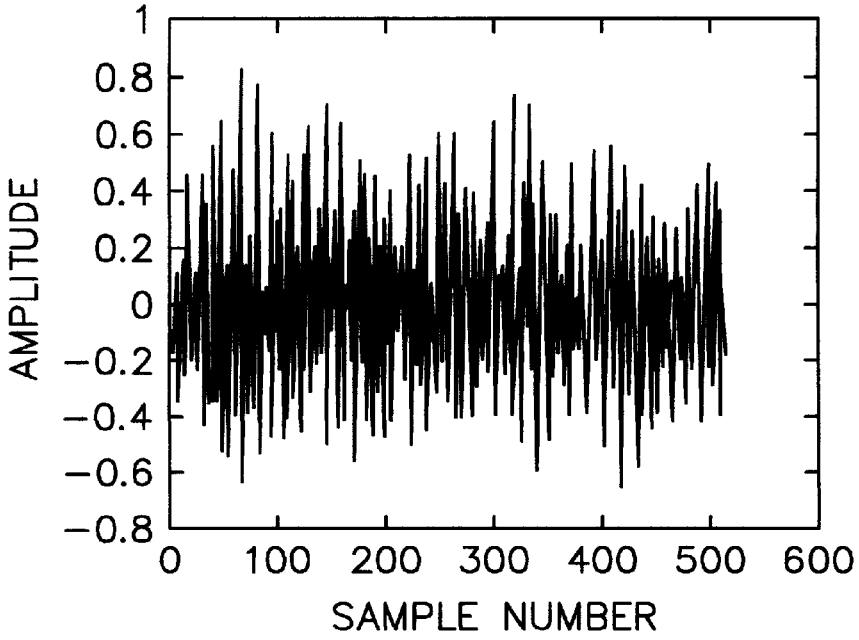
FIG. 10*a* is a time domain representation of the periodic portion of a guitar signal.
Figure 10B:
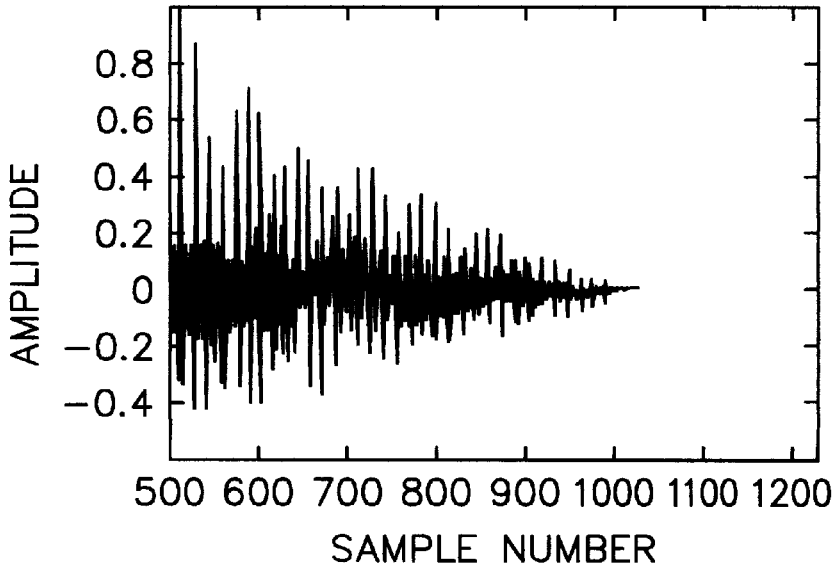
FIG. 10*b* is the autocorrelation of the guitar signal shown in FIG. 10*a;*

As will be appreciated by those skilled in the art, the method for computing the autocorrelation function is not limited to summing the lagged products. The autocorrelation function may, for instance, be computed by a fast Fourier transform algorithm, within the spirit and scope of the invention. FIG. 10*a* is a time domain representation of the periodic portion of a guitar signal sampled at a rate of 3000 samples per second. FIG. 10*b* is the autocorrelation of the guitar signal shown in FIG. 10*a*. FIG. 10*b* illustrates the enhanced signal-to-noise ratio resulting from autocorrelating the signal samples.

In the preferred embodiment there are three alternative methods for determining the fundamental frequency of the segment, all of which use the autocorrelation function output signal. As shown in FIGS. 9–9*a*, the specific method for computing the fundamental frequency is selected by the user (step 304), based primarily on the processing power of the processor 20. In the preferred embodiment, the combination of the spectral analysis and direct peak methods is the most accurate but requires the greatest processing power of the processor 20. The spectral analysis method is the next most accurate and the direct peak method is the least accurate. If the direct peak method (step 325) is selected, the fundamental frequency of a segment is based solely on measuring the distance between at least two peaks of the autocorrelation of the input signal. At step 326, the magnitude of each peak of the autocorrelation of the input signal is determined, and up to five thresholds are determined corresponding to the magnitudes of the five highest peaks, excluding the highest peak. At step 328 a set of peaks is selected such that the magnitudes of the peaks all exceed the lowest threshold value and the location (sample number) of each selected peak is determined. At step 330, the distance between each pair of adjacent autocorrelation peaks is determined. At step 332, the mean and variance of the distances is computed. At step 334 the variance of the distances is compared with a predetermined value. If the distance variance is less than the predetermined value, the fundamental frequency is computed at step 336 as the reciprocal of the mean of the distances (expressed as fractional numbers of samples) divided by the sample rate, and processing is passed at step 348 to note declaration processing (step 400).

If the distance variance exceeds the predetermined variance threshold, the selected peak threshold is raised to the next higher value at step 340 and the process from step 328 to 334 is repeated until the distance variance is less than or equal to the predetermined value (step 334) or there are no more thresholds, as determined at step 338. If the variance test at step 334 is not successfully passed having examined all the selected autocorrelation peaks, the detection flag is tested at step 341. If the detection flag had been set equal to one, the segment is determined to be neither noise-like nor periodic, the current note is declared off and a signal is provided to the output device 15 indicating that the note has ended (step 342). The detection flag is then reset to zero (step 344) and processing is then returned at step 346 to step 103 to retrieve the next segment. If at step 340, the detection flag was not set to one, there not having been a note detected, no flags are altered and the processing returns to step 103 to retrieve the next sample.

If a spectral method (step 306) of determining the fundamental frequency has been selected at step 304, the short term spectrum of the segment is computed from the output sample of the autocorrelation computation previously performed at step 302. Desirably, the spectral analysis is performed at step 306 using a multitaper method of spectral analysis. (see for background D. J. Thompson, *Spectrum Estimation and Harmonic Analysis,* Proceedings of the IEEE, Vol. 70 (1982), Pg. 1055–1096.) However, as will be apparent to those skilled in the art, the spectral analysis may be by performed other methods, such as periodograms, within the spirit and scope of the invention.

Figure 11A:
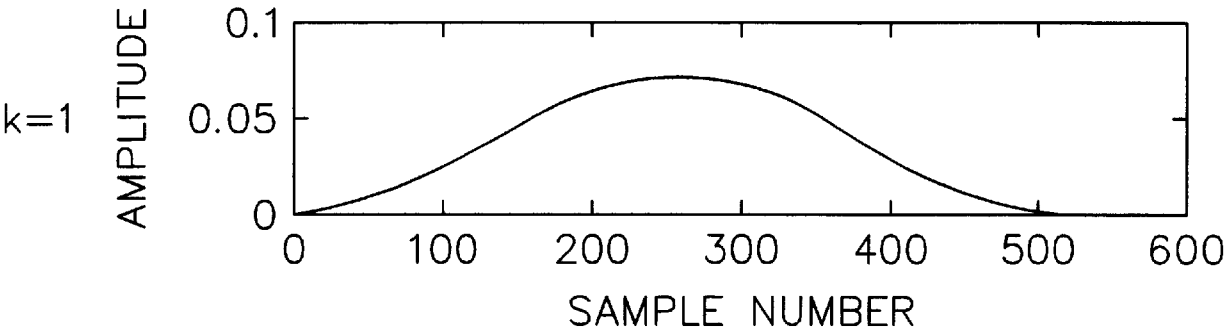
FIGS. 11*a–c* are the Slepian sequences for a time bandwidth product of 2.
Figure 11B:
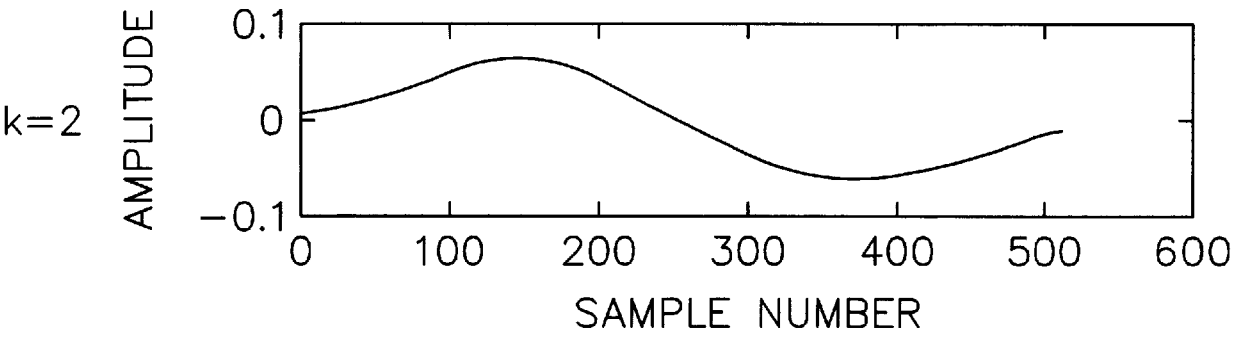
Figure 11C:
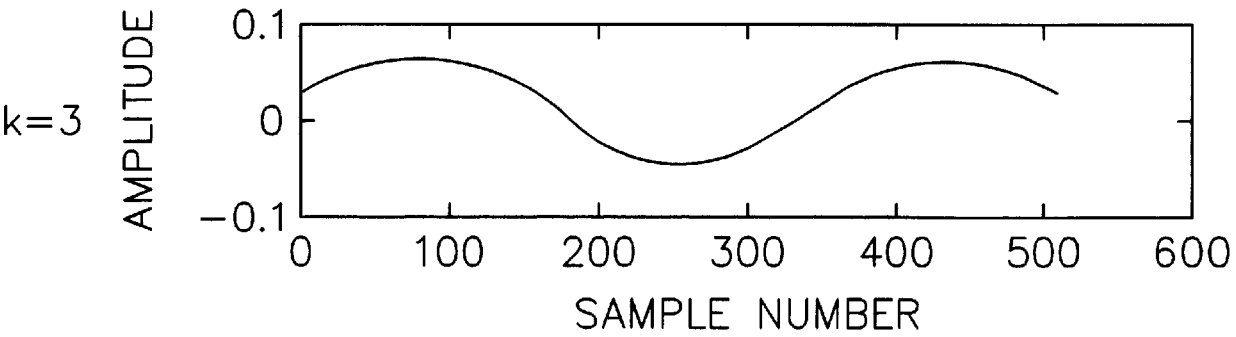
Figure 12A:
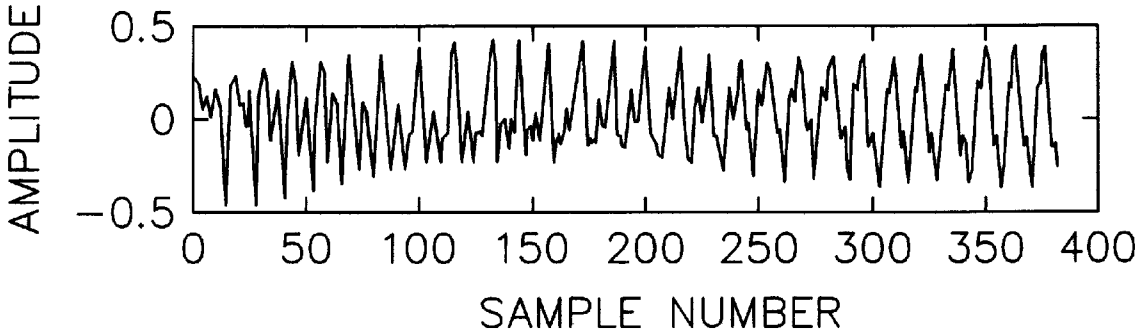
FIGS. 12*a–c* are respectively the a recorder input signal, the autocorrelation of the recorder signal and the power spectrum of the recorder signal.
Figure 12B:
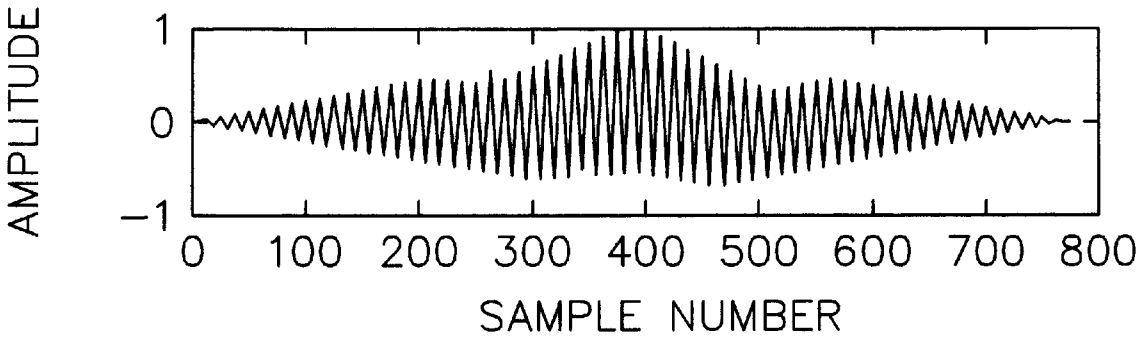
Figure 12C:
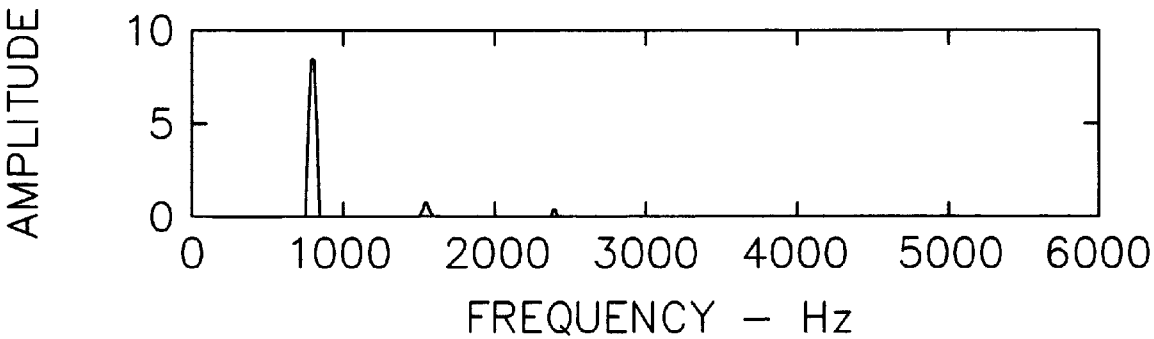

Accordingly, using the multitaper method at step 306, the spectrum of the input signal is estimated as the average of K direct spectral estimators according to equation (6).

$$\hat{S}^{(mt)}(f) \equiv \frac{1}{K}\sum_{k=0}^{K-1}\hat{S}_k^{(mt)}(f) \tag{6}$$

where the kth direct spectral estimator is given by equation (7) as:

$$\hat{S}_k^{(mt)}(f) \equiv \Delta t\left|\sum_{t=1}^{N} h_{t,k}\, X_t e^{-i2\pi f t\Delta t}\right|^2 \tag{7}$$

and $\Delta t$ is the autocorrelation function sampling period, the $X_t$ are samples of the autocorrelation function, N is the number of samples in the signal segment being analyzed and $h_{t,k}$ is the data taper for the kth spectral estimator. In the preferred embodiment, three direct spectral estimators (i.e. K=3) are used. The values of $h_{t,k}$, used in computing the direct spectral estimators are shown in FIGS. 11*a–c*. The $h_{t,k}$ sequences are the Slepian sequences for the time bandwidth product NW=2, where W is the desired frequency resolution (in Hz.) of the multitaper spectral analysis output (see for background Slepian, D., "*Uncertainty and Modeling*", SIAM Review, Vol. 25, 1983, Pg. 370–393). FIGS. 12*a–c* shows an analysis of a recorder signal having a pitch of 784 Hz., FIG. 12*a* illustrating the recorder time domain waveform, FIG. 12*b* illustrating the autocorrelation of the recorder signal and FIG. 12*c* illustrating the power spectrum of the recorder signal resulting from the multitaper computation.

Following the spectral analysis at step 306, a set of spectral peaks from the power spectrum is identified, where each peak in the set has a peak value greater than a predetermined value (steps 308–310). At step 312 the points surrounding each peak in the set of candidate spectral peaks are used to interpolate the true frequency and magnitude of the peaks, thus improving the resolution of the spectral analysis. At step 314–322, each peak in the candidate set is tested to determine if it is a fundamental frequency. Accordingly at step 314, a harmonic set of frequencies is generated from each candidate peak, the frequency of each harmonic being an integer multiple of the candidate frequency and the magnitude of each harmonic being based on the spectral magnitude of the desired note timbre.

Once a set of harmonics is generated, the harmonic set is compared to the set of candidate peaks. The candidate peak having the smallest error between the frequencies of the generated set and the true peak frequencies of the candidate set is selected as the fundamental frequency. In the preferred embodiment, the generated peak to candidate peak error is defined as:

$$Err_{p\to m} = \sum_{n=1}^{N}\Delta f_n\cdot(f_n)^{-p} + \left(\frac{a_n}{A_{\max}}\right)\times[q\Delta f_n\cdot(f_n)^{-p} - r] \tag{8}$$

where $\Delta f_n$ is the frequency difference between a generated peak and the closest candidate peak, $f_n$ and $a_n$ are respectively the frequency and magnitude of the generated peak, and Amax is the maximum generated peak magnitude; p=0.5, q=1.4, r=0.5 and p=0.33. The candidate peak to generated peak error is defined as:

$$Err_{m\to p} = \sum_{k=1}^{K}\Delta f_k\cdot(f_k)^{-p} + \left(\frac{a_k}{A_{\max}}\right)\times[q\Delta f_k\cdot(f_k)^{-p} - r] \tag{9}$$

where $\Delta_{fk}$ is the frequency difference between a candidate peak and the closest generated peak, $f_k$ and $a_k$ are respectively the frequency and magnitude of the respective candidate peak, and Amax is the maximum candidate peak magnitude. The total error, used to select the correct spectral peak as the fundamental frequency, is defined as:

$$Err_{total} = \frac{Err_{p\to m}}{N} + \frac{\rho Err_{m\to p}}{K} \tag{10}$$

At step 324, the frequency of the candidate peak having the smallest error as computed by equation (10) is selected as the fundamental frequency and the segment processing is passed at step 348 to the note declaration processing (step 400).

If the combined results of spectral analysis and direct peak measurement is selected at step 304, the fundamental frequency of each segment is computed by both the direct peak method and the spectral method and results from both computations are compared (steps 350–358). A confidence factor based on the difference between the frequencies computed by the spectral analysis and direct peak measurements is calculated at step 358, and the frequency determined by the spectral analysis is passed at step 348 to the note declaration process (step 400).

Figure 13:
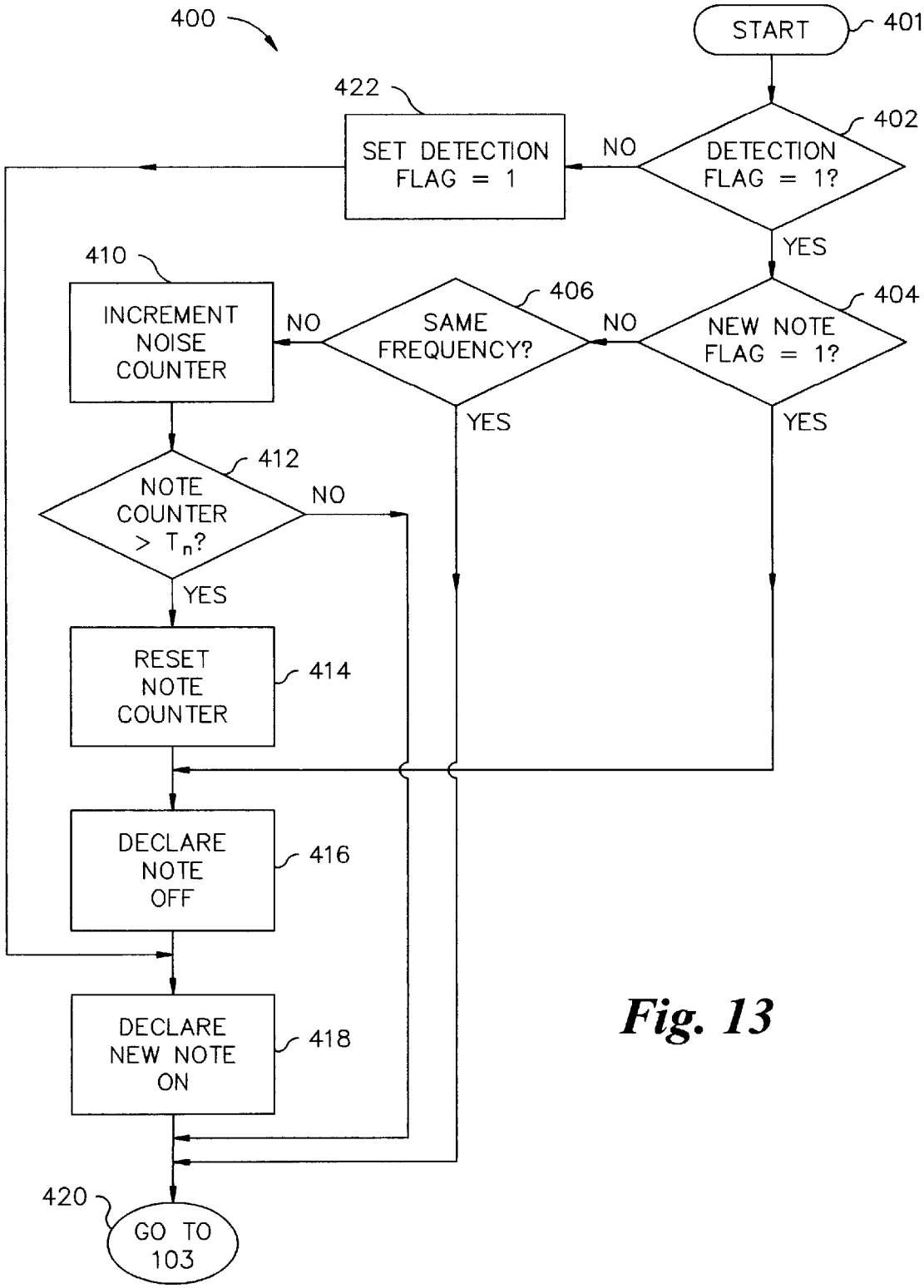
FIG. 13 is a flow diagram of the steps for outputting information to a user indicative of the pitch of the notes determined from the input signal.

Referring now to the preferred embodiment of the note declaration process (step 400), shown in FIG. 13, continues the processing for the current segment, in order to determine if the segment, determined to be periodic by the fundamental frequency process (step 300), is part of an existing note or the start of a new note. The detection flag is first tested at step 402 to determine if a note has been previously detected. If the detection flag is zero, the detection flag is set at step 422, a new note is declared on, a signal is output to the output device 15 indicating a new note (step 418) and the processing returns at step 420 to step 103 to retrieve the next segment. If the detection flag is found equal to one at step 402, the new note flag is tested at step 404. If the new note flag is found equal to one at step 404, the segment is determined to be the start of a new note, the current note is declared off, a first signal is output to the output device 15 indicating that the current note has ended (step 416), a new note is declared on, a second signal is output to the output device 15 indicating that a new note has started (step 418) and the processing returns at step 420 to step 103 to retrieve the next segment.

If the detection flag is tested to be equal to one at step 402 and the new note flag is tested to be zero at step 404, the fundamental frequency of the note determined in step 300 is compared with the fundamental frequency of the previous segment, at step 406, to determine if the note is a "slider". If the current segment is determined to be the same frequency, processing returns to step 103. If the frequency has changed, the note counter is incremented, (step 410), and if the counter is less than the predetermined maximum value (step 412) processing continues at step 103. If, however, a large number of successive frequency changes is detected by the note counter, exceeding the predetermined maximum value, the note counter is reset at step 414, the current note is declared off at step 416, a new note is declared on at step 418 and processing returns to step 103.

From the foregoing description it can be seen that the preferred embodiment of the invention comprises an improved method and apparatus for detecting and displaying the pitch of a musical signal to a musician in real time. The present invention employs a simple method for excising noisy portions of the musical signal, thereby reducing the computational load on the processor 20 and resulting in a computational burden within the capability of off-the-shelf personal computers. The present invention further provides an improved means of computing pitch which is adaptable to computers of varying capabilities. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A computerized method for detecting a pitch of a musical signal comprising the steps of:

receiving an electrical signal representative of the musical signal;

identifying an active portion of the musical signal, the active portion comprising at least one of a noisy portion and a periodic portion;

identifying the periodic portion of the active portion of the musical signal;

determining a fundamental frequency of the periodic portion of the musical signal; and generating a pitch signal based on the fundamental frequency.

2. The method of claim 1, wherein the step of identifying the periodic portion comprises the steps of:

filtering the received musical signal;

detecting a mean value of the amplitude of the musical signal; and comparing the mean value of the amplitude of the musical signal with at least one predetermined detection threshold value to identify the active portion of the musical signal and identifying the active portion of the musical signal as the periodic portion if the musical signal is known not to be noisy.

3. The method of claim 2, wherein the step of identifying the periodic portion further comprises:

computing a local fractal dimension of the active portion of the musical signal if the musical signal is not known to be not noisy;

comparing the local fractal dimension of the musical signal with a predetermined fractal dimension threshold value;

identifying the active portion of the musical signal as the periodic portion when the local fractal dimension exceeds the fractal dimension threshold.

4. The method of claim 3 wherein the local fractal dimension is computed using the method of relative dispersion.

5. The method of claim 3 wherein the detection and fractal dimension threshold values are user determined.

6. The method of claim 5 wherein at least one detection threshold value is based on a change of the mean amplitude of the musical signal.

7. The method of claim 1 wherein the fundamental frequency is determined by the steps of:

autocorrelating the periodic portion of the musical signal to generate at least two correlation peaks;

determining a correlation peak location and a correlation peak magnitude for each correlation peak;

selecting a set of at least two correlation peaks, each correlation peak of the set having a correlation peak magnitude equal to or exceeding the magnitude of the smallest correlation peak in the set;

measuring a distance between each pair of adjacent correlation peaks in the set;

computing a mean and a variance of the distance between the adjacent correlation peaks; and computing a reciprocal of the mean distance if the variance of the distance is less than a predetermined value.

8. The method of claim 1 wherein the fundamental frequency is determined by the steps of:

autocorrelating the periodic portion of the musical signal to generate an autocorrelation signal;

generating a power spectrum signal of the musical signal from the autocorrelation signal to generate at least one spectral peak;

identifying a set of spectral peaks from the power spectrum spectral peaks having a peak magnitude greater than a predetermined value;

interpolating power spectrum magnitude values of the set of spectral peaks to determine a true peak frequency and a true peak magnitude of each spectral peak in the set;

testing the true peak frequency of each spectral peak in the set as representing the fundamental frequency by determining a frequency error between a set of integer harmonics of each spectral peak in the set and the true peak frequency of each spectral peak in the set; and determining the fundamental frequency as the true peak frequency of the spectral peak in the set having the smallest error.

9. The method of claim 8 wherein the power spectrum is computed using a multitaper method of spectral analysis.

10. A computer readable medium having a computer executable program code stored thereon, the program code for determining the pitch of a musical signal, the program comprising;

code for receiving an electrical representation of a musical signal;

code for identifying an active portion of the musical signal;

code for identifying a periodic portion of the musical signal;

code for determining a fundamental frequency of the periodic portion of the musical signal; and code for generating a pitch signal based on the fundamental frequency.

11. A programmed computer for determining the pitch of a musical signal comprising:

an input device for receiving an electrical representation of a musical signal;

a storage device having a portion for storing computer executable program code;

a processor for executing the computer program stored in the storage device wherein the processor is operative with the computer program code to: receive the electrical representation of the musical signal; identify an active portion of the musical signal; identify a periodic portion of the musical signal; and determine a fundamental frequency of the periodic portion of the musical signal; and an output device for outputting a pitch signal based on the fundamental frequency.

* * * * *